US009720338B2

(12) United States Patent
Tamemasa

(10) Patent No.: US 9,720,338 B2
(45) Date of Patent: Aug. 1, 2017

(54) CYLINDRICAL SUPPORT FOR ELECTROPHOTOGRAPHIC PHOTORECEPTOR, ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Hiroshi Tamemasa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/795,365

(22) Filed: Jul. 9, 2015

(65) Prior Publication Data

US 2016/0223925 A1 Aug. 4, 2016

(30) Foreign Application Priority Data

Feb. 2, 2015 (JP) ..... 2015-018498

(51) Int. Cl.
*G03G 21/16* (2006.01)
*G03G 5/10* (2006.01)
*G03G 5/06* (2006.01)

(52) U.S. Cl.
CPC ..... *G03G 5/102* (2013.01); *G03G 5/0614* (2013.01); *G03G 5/0696* (2013.01)

(58) Field of Classification Search
CPC ..... G03G 21/1842; G03G 21/1821; G03G 21/18; G03G 21/1647; G03G 21/1814
USPC ..... 399/111
See application file for complete search history.

(56) References Cited

U.S. PATENT DOCUMENTS 5,587,029 A * 12/1996 Sircar ..... C22C 21/003 148/438
2002/0031682 A1* 3/2002 Dif ..... B32B 15/016 428/654
2006/0127782 A1* 6/2006 Ishida ..... G03G 5/047 430/60
2009/0142092 A1* 6/2009 Sato ..... G03G 21/1846 399/111

FOREIGN PATENT DOCUMENTS

JP S59-228255 A 12/1984
JP S61-44148 A 3/1986
JP H02-250936 A 10/1990
(Continued)

OTHER PUBLICATIONS

Translation of Okada (JP 2006-188730 A) listed in the IDS, publication date: Jul. 20, 2006.*
(Continued)

*Primary Examiner* — Walter L Lindsay, Jr.
*Assistant Examiner* — Frederick Wenderoth
(74) *Attorney, Agent, or Firm* — Oliff PLC

(57) ABSTRACT

A cylindrical support for an electrophotographic photoreceptor includes an aluminum alloy including Si: 0.4% by weight to 0.8% by weight, Fe: 0.7% by weight or less, Cu: 0.15% by weight to 0.4% by weight, Mn: 0.15% by weight or less, Mg: 0.8% by weight to 1.2% by weight, Cr: 0.04% by weight to 0.35% by weight, Zn: 0.25% by weight or less, Ti: 0.15% by weight or less, and a balance: aluminum and impurities, wherein an average area of crystal grains of the aluminum alloy is from 3.0 $\mu m^2$ to 100 $\mu m^2$.

10 Claims, 9 Drawing Sheets

(56) References Cited

FOREIGN PATENT DOCUMENTS

| | | | |
|---|---|---|---|
| JP | H03-028343 | A | 2/1991 |
| JP | H09-316580 | A | 12/1997 |
| JP | 2000-313947 | A | 11/2000 |
| JP | 2001-316751 | A | 11/2001 |
| JP | 2006-188730 | A | 7/2006 |

OTHER PUBLICATIONS

Translation of Soyama (JP 2001-316751 A) listed in the IDS, publication date: Nov. 16, 2001.*
Apr. 4, 2017 Office Action issued in Japanese Patent Application No. 2016-064334.

* cited by examiner

CYLINDRICAL SUPPORT FOR ELECTROPHOTOGRAPHIC PHOTORECEPTOR, ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-018498 filed Feb. 2, 2015.

BACKGROUND

1. Technical Field

The present invention relates to a cylindrical support for an electrophotographic photoreceptor, an electrophotographic photoreceptor, a process cartridge, and an image forming apparatus 2. Related Art In the related art, as an electrophotographic image forming apparatus, an apparatus which sequentially performs processes of charging, exposure, development, transfer, cleaning and the like using an electrophotographic photoreceptor has been widely known.

As an electrophotographic photoreceptor, a functions separation type electrophotographic photoreceptor obtained by layering a charge generating layer which generates charges upon exposure and a charge transporting layer which transports the charges on a conductive support of aluminum or the like, and a single layer type electrophotographic photoreceptor including a single layer having a function of generating charges and a function of transporting the charges have been known.

SUMMARY

According to an aspect of the invention, there is provided a cylindrical support for an electrophotographic photoreceptor including:

an aluminum alloy including

Si: 0.4% by weight to 0.8% by weight,

Fe: 0.7% by weight or less,

Cu: 0.15% by weight to 0.4% by weight,

Mn: 0.15% by weight or less,

Mg: 0.8% by weight to 1.2% by weight,

Cr: 0.04% by weight to 0.35% by weight,

Zn: 0.25% by weight or less,

Ti: 0.15% by weight or less, and a balance: aluminum and impurities, wherein an average area of crystal grains of the aluminum alloy is from 3.0 $\mu m^2$ to 100 $\mu m^2$.

BRIEF DESCRIPTION OF THE DRAWINGS

Exemplary embodiments of the present invention will be described in detail based on the following figures, wherein.

DETAILED DESCRIPTION

Figure 1:
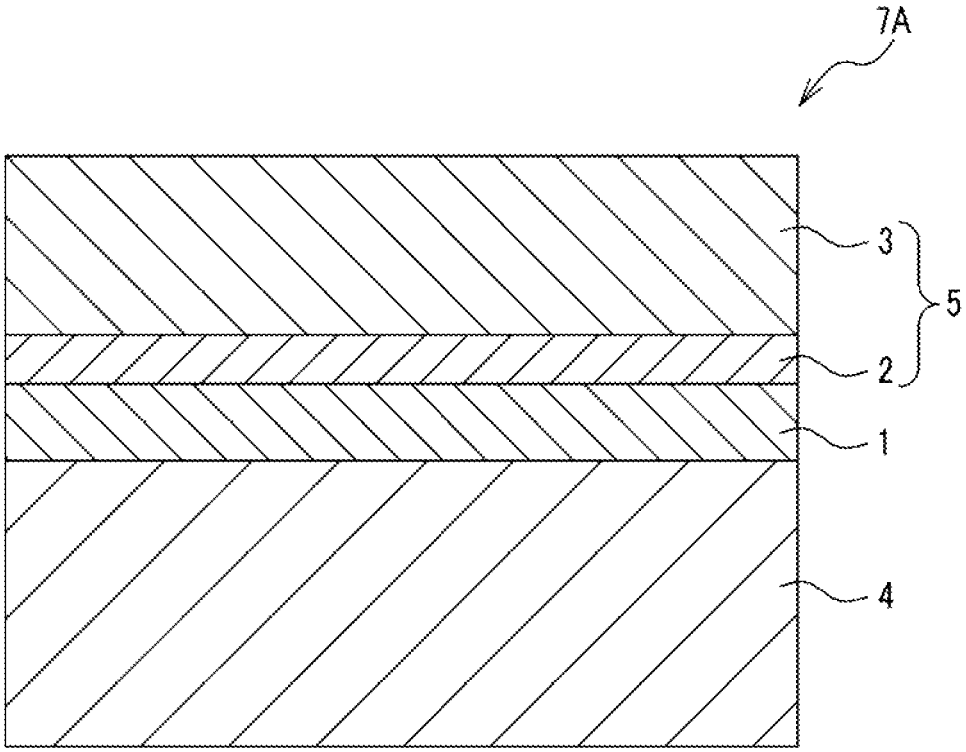
FIG. 1 is a partial cross-sectional view schematically illustrating a configuration example of an electrophotographic photoreceptor according to an exemplary embodiment.

Hereinafter, exemplary embodiments of the invention will be described with reference to the accompanying drawings. In the drawings, elements having the same function will be denoted by the same reference numerals and overlapping descriptions will be omitted.

Cylindrical Support for Electrophotographic Photoreceptor

A cylindrical support for an electrophotographic photoreceptor (hereinafter, sometimes simply referred to as "a support") according to an exemplary embodiment includes an aluminum alloy containing Si: 0.4% by weight to 0.8% by weight, Fe: 0.7% by weight or less, Cu: 0.15% by weight to 0.4% by weight, Mn: 0.15% by weight or less, Mg: 0.8% by weight to 1.2% by weight, Cr: 0.04% by weight to 0.35% by weight, Zn: 0.25% by weight or less, Ti: 0.15% by weight or less, and a balance: aluminum and unavoidable impurities (hereinafter, sometimes simply referred to as "a specific aluminum alloy"). The average area of the crystal grains of the aluminum alloy is from 3.0 $\mu m^2$ to 100 $\mu m^2$.

Due to the fact that the support according to the exemplary embodiment has the above configuration, even when the thickness of the support is reduced (hereinafter, the thickness of the support is referred to as "wall thickness" and reducing the thickness is referred to as "thickness reduction"), a support having high strength and high shape accuracy may be obtained. Although the reason is not clear, it may be assumed as follows.

Generally, as the support used for an electrophotographic photoreceptor (hereinafter, sometimes referred to as "a photoreceptor"), in order to improve cylindricity, a material having high hardness and excellent workability is selected. Specifically, the cylindricity of the support is improved by controlling various physical properties such as a Young's modulus.

For example, when the support is prepared using pure aluminum having excellent workability, high shape accuracy (for example, cylindricity) may be obtained. However, since pure aluminum is soft, the strength may be low. Therefore, for example, when the thickness of the support is reduced (for example, 0.4 mm or less), the support may be easily plastically deformed (permanently deformed) in the case in which external force is applied to the support, and a function as a support is not easily exhibited in some cases.

On the other hand, when the support is prepared using an aluminum alloy having high hardness which is work-hardened so that high strength may be obtained even in the case in which the thickness of the support is reduced, the support itself is deformed due to the residual strain during working and thus the shape accuracy may be lowered.

Contrarily, since the workability of the support according to the exemplary embodiment may be improved by using a specific aluminum alloy in a process of preparing a support, the shape accuracy is improved. Since the average area of crystal grains of the specific aluminum alloy is in the above range when the support is prepared, the strength against external force is improved. Therefore, it is assumed that a support having high strength and high shape accuracy may be obtained even when the thickness is reduced.

According to the support of the exemplary embodiment, since a support having high strength and high shape accuracy may be obtained, image reproducibility is improved and image defects such as reduced concentration or voids are prevented. In addition, the amount of the aluminum alloy used may be reduced by reducing the thickness.

Electrophotographic Photoreceptor

An electrophotographic photoreceptor according to an exemplary embodiment includes the support according to the exemplary embodiment, a photosensitive layer that is arranged on the support.

FIG. 1 is a cross-sectional view schematically illustrating an example of a layer configuration example of an electrophotographic photoreceptor 7A according to an exemplary embodiment. The electrophotographic photoreceptor 7A shown in FIG. 1 has a structure in which an undercoat layer 1, a charge generating layer 2, and a charge transporting layer 3 are layered in this order on the support 4. In this case, the charge generating layer 2 and the charge transporting layer 3 constitute a photosensitive layer 5.

FIGS. 2 to 5 are cross-sectional views each schematically illustrating other layer configuration examples of the electrophotographic photoreceptor according to the exemplary embodiment.

Figure 2:
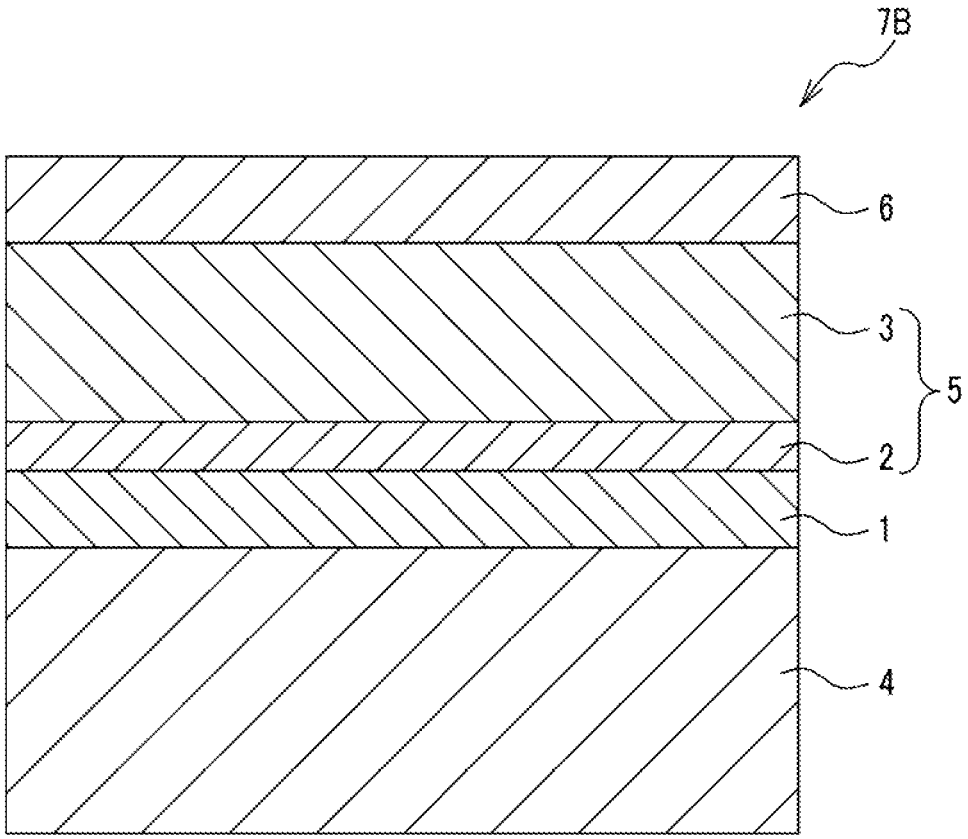
FIG. 2 is a partial cross-sectional view schematically illustrating another configuration example of the electrophotographic photoreceptor according to the exemplary embodiment.
Figure 3:
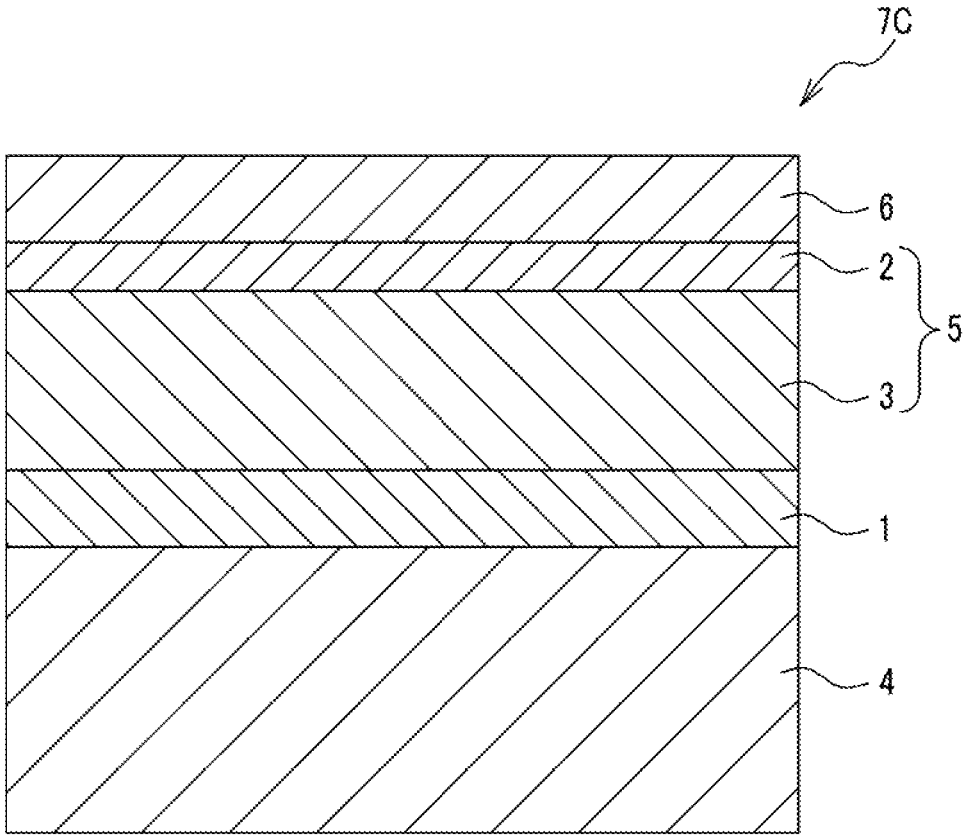
FIG. 3 is a partial cross-sectional view schematically illustrating another configuration example of the electrophotographic photoreceptor according to the exemplary embodiment.

Electrophotographic photoreceptors 7B and 7C illustrated in FIGS. 2 and 3 include the photosensitive layer 5 in which the charge generating layer 2 and the charge transporting layer 3 have separate functions similarly to the case of the electrophotographic photoreceptor 7A illustrated in FIG. 1, and a protective layer 6 is formed as the outermost layer. The electrophotographic photoreceptor 7B illustrated in FIG. 2 has a structure in which the undercoat layer 1, the charge generating layer 2, the charge transporting layer 3, and the protective layer 6 are sequentially layered on the support 4. The electrophotographic photoreceptor 7C illustrated in FIG. 3 has a structure in which the undercoat layer 1, the charge transporting layer 3, the charge generating layer 2, and the protective layer 6 are sequentially layered on the support 4.

Figure 4:
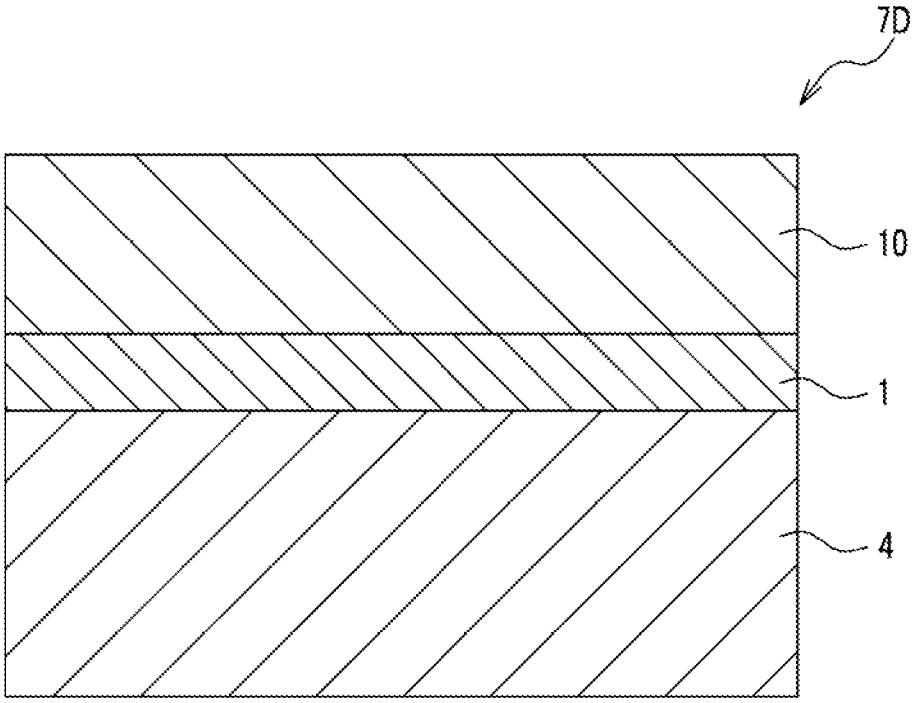
FIG. 4 is a partial cross-sectional view schematically illustrating another configuration example of the electrophotographic photoreceptor according to the exemplary embodiment.
Figure 5:
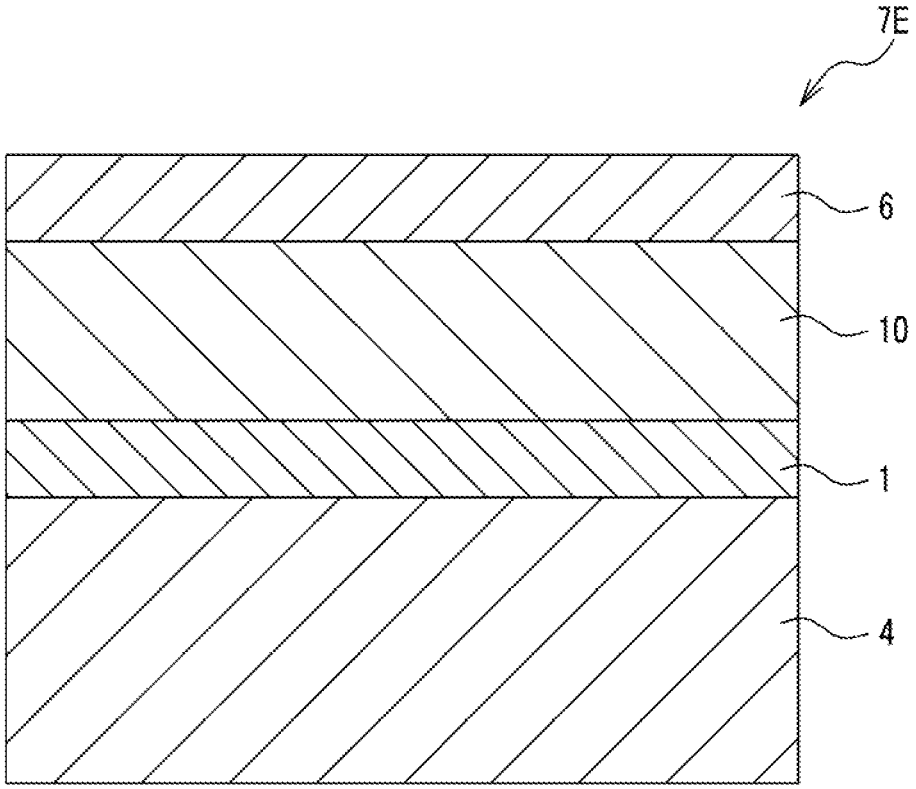
FIG. 5 is partial cross-sectional view schematically illustrating another configuration example of the electrophotographic photoreceptor according to the exemplary embodiment.

On the other hand, in the electrophotographic photoreceptors 7D and 7E illustrated in FIGS. 4 and 5, a single layer (single layer type photosensitive layer 10) contains a charge generating material and a charge transporting material and functions are integrated. The electrophotographic photoreceptor 7D illustrated in FIG. 4 has a structure in which the undercoat layer 1 and the single layer type photosensitive layer 10 are sequentially layered on the support 4. The electrophotographic photoreceptor 7E illustrated in FIG. 5 has a structure in which the undercoat layer 1, the single layer type photosensitive layer 10, and the protective layer 6 are sequentially layered on the support 4.

In the respective electrophotographic photoreceptors 7A to 7E, the undercoat layer 1 and the protective layer 6 may not be necessarily provided.

Hereinafter, the respective components of the electrophotographic photoreceptor will be described. The reference numerals of the respective components will be omitted in the following description.

Support

The support according to the exemplary embodiment includes the specific aluminum alloy having the above component composition.

Specific Aluminum Alloy

Si and Ng

Si is contained in a range of from 0.4% by weight to 0.8% by weight, and Mg in a range of from 0.8% by weight to 1.2% by weight. When the contents of Si and Mg are in the above ranges, the strength of the support may be improved. Si coexists with Mg and forms $Mg_2Si$ precipitates so as to improve the strength of the support.

Cu

Cu is contained in a range of from 0.15% by weight to 0.4% by weight. When the content of Cu is in the above range, the strength of the support may be improved. Cu increases $Mg_7Si$ precipitates so as to increase the strength of the support.

Fe

Fe is contained in a range of 0.7% by weight or less. When the content of Fe is in the above range, the strength of the support may be improved. Fe is bonded with Al and Si in the alloy to thereby be crystallized, and also has a function capable of preventing coarsening of crystal grains. The lower limit of the content of Fe is not particularly limited and may be, for example, 0.05% by weight or more.

Mn, Cr, Zn, and Ti

Mn is contained in a range of from 0.15% by weight or less, Cr is contained in a range of from 0.04% by weight to 0.35% by weight, Zn is contained in a range of from 0.25% by weight or less, and Ti is contained in a range of from 0.15% by weight or less. When the contents of Mn, Cr, Zn, and Ti are in the above ranges, refined crystal grains may be obtained. In addition, coarsening of crystal grains may be prevented. The lower limits of the contents of Mn, Zn, and Ti are not particularly limited and for example, the lower limit of the content of Mn is 0.03% by weight or more, the lower limit of the content of Zn is 0.03% by weight or more, and the lower limit of the content of Ti is 0.03% by weight or more, respectively.

Impurities

The specific aluminum alloy contains impurities other than the respective above components and aluminum. The impurities may be contained in raw materials of aluminum, and in a process of manufacturing a specific aluminum alloy base metal. In addition, for example, there are components such as Ga, V, Ni, B, Zr, and Ca as the impurities.

Average Area of Crystal Grains

In the support of the exemplary embodiment, the average area of crystal grains of the specific aluminum alloy is from 3.0 $\mu m^2$ to 100 $\mu m^2$ as described above. From the viewpoint of obtaining a support having higher strength and higher shape accuracy even when the thickness is reduced, the average area is preferably in a range of from 5.0 $\mu m^2$ to 80 $\mu m^2$. The average area is more preferably in a range of from 7.0 $\mu m^2$ to 70 $\mu m^2$.

Here, in the support of the exemplary embodiment, the "crystal grains" of the specific aluminum alloy refer to each crystal of a polycrystalline structure constituting the specific aluminum alloy. The "average area of crystal grains" refers to an average value of areas of crystal grains.

The average area of crystal grains is a value obtained by observing and measuring areas of crystal grains with a scanning electron microscope (SEM). Specifically, the measurement is performed as follows.

First, at each of positions 5 mm distant from one end and the other end of the support in an axial direction and the center position of the support in the axial direction, sample for measurement are prepared from 4 places (total of 4×3=12 places) every 90 degrees in a circumferential direction. Next, the samples for measurement are embedded with an epoxy resin and then are subjected to a polishing treatment. The polishing treatment is performed by polishing the sample by the use of waterproof abrasive paper #500, followed by buffing for mirror finishing. The samples for measurement subjected to the polishing treatment are observed and measured using VE SEM (manufactured by KEYENCE Corporation).

In the cross-section of each sample, the area of a crystal grain, which is located at a position corresponding to a range of 30 μm×20 μm (axial direction×thickness direction) from the outer peripheral surface of the substrate, is calculated by image processing software installed on the above-described VE SEM (manufactured by KEYENCE Corporation), the areas of crystal grains of the samples of the 12 places are averaged by the number of the samples, and the average value is set as the average area of crystal grains in the substrate.

A method of measuring the average area of crystal grains of a photoreceptor to be measured is as follows.

First, a photoreceptor to be measured is prepared. Next, for example, a photosensitive layer such as a charge generating layer, and a charge transporting layer and an undercoat layer are removed using a solvent or means such as tools to expose the undercoat layer. Further, the exposed undercoat layer is removed to form a sample for measurement. Then, the average area of crystal grains of the support is measured in the sample for measurement in the above-described procedures.

A method of manufacturing the support according to the exemplary embodiment is not particularly limited as long as the average area of crystal grains of the support is in the above range.

As the method of manufacturing the support, for example, a method including processes of a process of preparing a specific aluminum alloy, a first working process of performing cold impact pressing on the specific aluminum alloy to form a molded product, a process of performing solution treatment on the molded product obtained in the first working process, a second working process of performing shape machining on the solution-treated molded product, and a process of performing age-hardening treatment on the molded product subjected to shape machining may be used.

Hereinafter, each process of the above manufacturing method will be described.

Figure 6C:
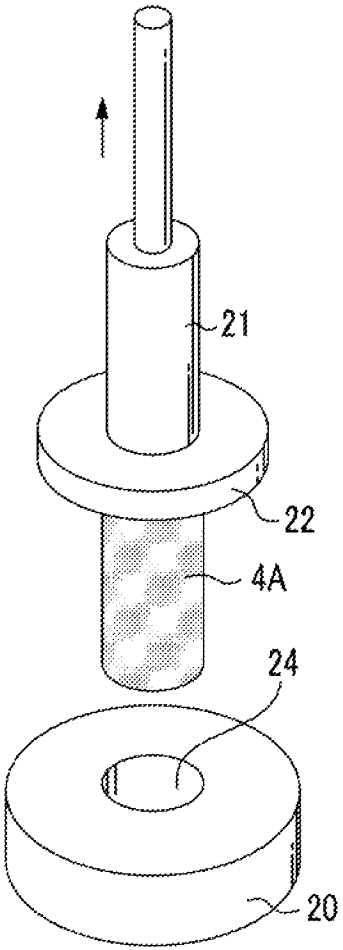
FIGS. 6A to 6C are diagrams schematically illustrating a part (impact pressing) of a process of manufacturing a support according to the exemplary embodiment.
Figure 6B:
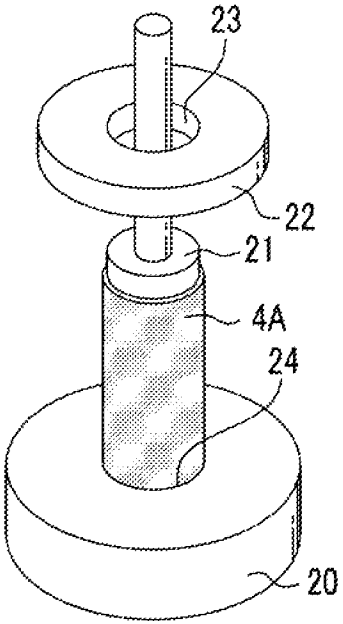
Figure 6A:
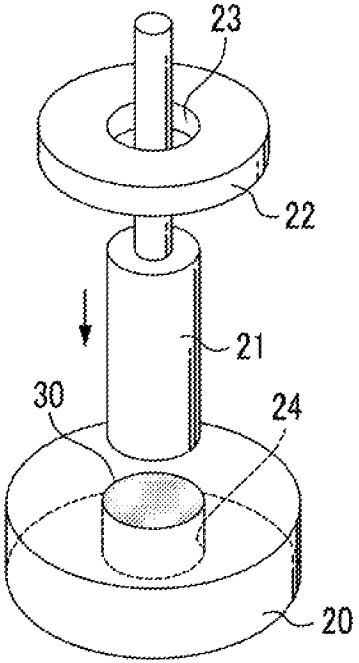
Figure 7B:
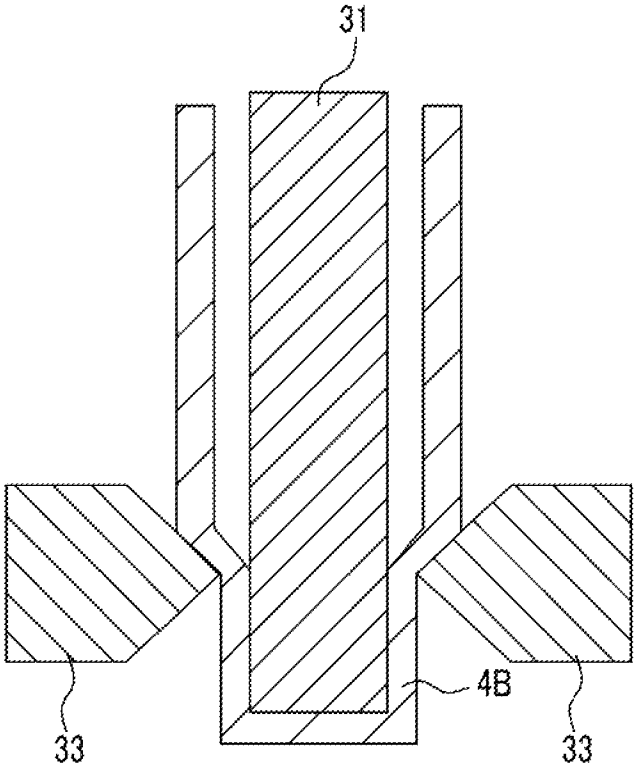
FIGS. 7A and 7B are diagrams schematically illustrating a part (drawing and ironing) of the process of manufacturing the support according to the exemplary embodiment.
Figure 7A:
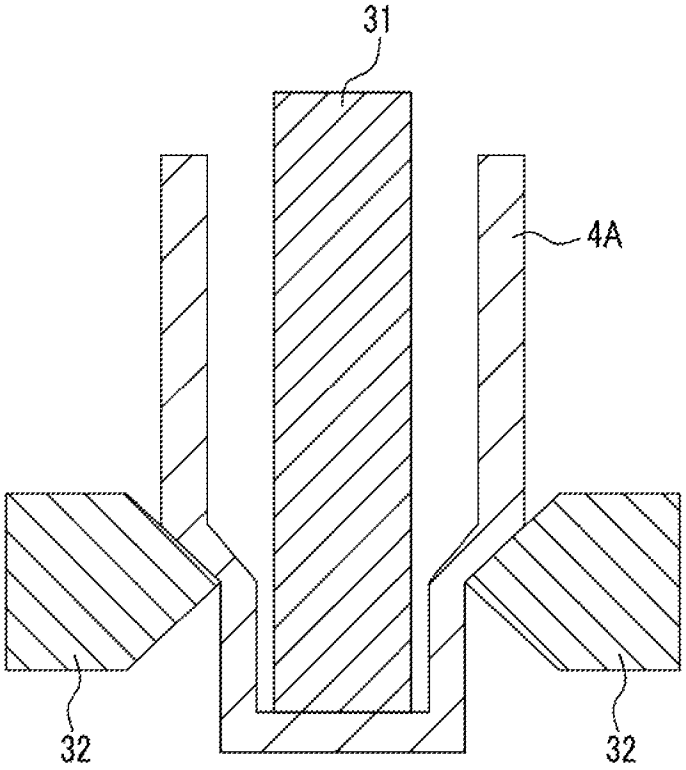

FIGS. 6A to 6C are diagrams schematically illustrating an example of a process in which a workpiece formed of a specific aluminum alloy (hereinafter, sometimes simply referred to as "a slag") is formed into a cylindrical molded product by cold impact pressing (hereinafter, sometimes simply referred to as "impact pressing"). FIGS. 7A and 7B are diagrams illustrating an example of a process in which an outer peripheral surface of the cylindrical molded product molded by impact pressing is ironed to manufacture the support according to the exemplary embodiment.

Preparation of Specific Aluminum Alloy

First, a specific aluminum alloy which is a material to be worked is prepared and is coated with a lubricant to prepare a slag 30 of a specific aluminum alloy.

When a metal including aluminum other than the specific aluminum alloy (for example, pure aluminum) is used, a support having high hardness and high strength may not be obtained even by the following processes.

Impact Pressing (First Working)

The slag 30 of a specific aluminum alloy, which is coated with a lubricant, is set in a circular hole 24 which is provided in a die (female) 20 as illustrated in FIG. 6A. Next, as illustrated in FIG. 6B, the slag 30 set in the die 20 is pressed by a cylindrical punch (male) 21. Thus, the slag 30 is stretched and molded in a cylindrical shape from the circular hole 24 of the die 20 so as to cover the periphery of the punch 21. After molding, as illustrated in FIG. 6C, the punch 21 is pulled up and is caused to pass through a central hole 23 of a stripper 22. As a result, the punch 21 is removed and a cylindrical molded product 4A is obtained.

Through such impact pressing, the hardness is improved by work hardening and thus the cylindrical molded product 4A which has a small thickness and high hardness and is formed of an aluminum alloy is manufactured.

The thickness of the molded product 4A is not particularly limited. For example, when a support having a thickness (wall thickness) of 0.03 mm to 1.5 mm is prepared, the thickness of the molded product 4A molded by impact pressing is preferably from 0.1 mm to 2.0 mm and more preferably from 0.05 m to 1.7 mm.

Solution Treatment

The cylindrical molded product 4A molded by impact pressing is heated and then cooled. Through this treatment, the specific aluminum alloy constituting the cylindrical molded product 4A becomes in a state in which the alloy component is evenly solid-soluted (that is, a state in which the alloy component is dissolved in the aluminum alloy) and becomes soft.

The solution treatment may be performed at a heating temperature in a range of from 300° C. to 600° C. From the viewpoint of further improving shape accuracy, the heating temperature is preferably in a range of from 350° C. to 600° C. The heating temperature is more preferably in a range of from 380° C. to 600° C.

In addition, the heating time may be in a range of from 0.2 hours to 4.0 hours. From the viewpoint of further improving shape accuracy, the heating time is preferably in a range of from 0.4 hours to 3.0 hours. The heating time is more preferably in a range of from 0.5 hours to 2 hours.

As for the cooling rate for cooling the cylindrical molded product 4A heated by the solution treatment, from the viewpoint of achieving a state in which the alloy component in the specific aluminum alloy is dissolved and becomes soft, the cylindrical molded product 4A may be cooled at a cooling rate of, for example, 1° C./sec or more. In addition, the cooled specific aluminum alloy may be cooled to a temperature in a range, for example, from room temperature (for example, 25° C.) to 100° C.

Shape Machining (Second Working)

Next, the solution-treated cylindrical molded product 4A is subjected to shape machining and the shape of the molded product 4A is corrected. In the shape machining, the solution-treated cylindrical molded product 4A is pushed into a die 32 from the inside by the cylindrical punch 31, for example, as illustrated in FIG. 7A so as to be subjected to drawing and the diameter is reduced. Then, as illustrated in FIG. 7B, the molded product is pushed into a die 33 having a diameter which has been further reduced so as to be subjected to ironing. In the shape machining, ironing may be performed without drawing or ironing may be performed in plural stages in a divided manner. That is, either or both of drawing or ironing may be performed. The thickness and cylindricity of the molded product 4B may be adjusted in accordance with the number of ironing operations.

The thickness of the shape-machined molded product 4B is not particularly limited. For example, when a support having a thickness (wall thickness) of from 0.03 mm to 1.5 mm is prepared, the thickness of the molded product is preferably from 0.1 mm to 2.0 mm and more preferably from 0.05 mm to 1.7 mm.

Age-Hardening Treatment

Next, the cylindrical molded product 4B whose shape has been corrected by the shape machining is heated and kept. Through this treatment, the alloy component is precipitated from the specific aluminum alloy constituting the cylindrical molded product 4B (that is, precipitation strengthening) and the obtained support has high hardness and high strength.

The age-hardening treatment may be performed at a heating temperature in a range of from 100° C. to 300° C. from the viewpoint of improving the strength of the support. The keeping time may be 1 hour or more. The upper limit of the keeping time is not particularly limited and is preferably in a range of, for example, 3 hours or less.

Through the above manufacturing process, a support having a high strength and a high shape accuracy may be obtained even when the thickness thereof is reduced. That is, the above properties may be obtained through processes of working a molded product by cold impact pressing, softening the molded product by solution treatment, and correcting the shape of the softened molded product by shape machining, and further, precipitating an alloy component by age-hardening treatment. When the thickness is reduced, a support having a reduced weight may be obtained.

The support of the exemplary embodiment may be prepared so as to have a thickness (wall thickness) of, for example, from 0.03 mm to 1.5 mm. From the viewpoint of preparing a support having higher strength and higher shape accuracy, the thickness is more preferably from 0.05 mm to 1.0 am, still more preferably from 0.1 mm to 0.9 am, and particularly preferably from 0.2 mm to 0.8 ma.

A support having an average area of crystal grains of 3.0 $\mu m^2$ to 100 $\mu m^2$ may be obtained by preparing the support of the exemplary embodiment by each of the above processes. When the support is prepared by the above processes, the average area of crystal grains may be adjusted by controlling, for example, the conditions for solution treatment (heating condition and cooling condition) and the conditions for age-hardening treatment.

The support of the exemplary embodiment has high shape accuracy (such as cylindricity). The cylindricity is a value expressed by a number showing the size of error from a geometrical cylinder which is a portion that has to be a cylinder. For example, the support of the exemplary embodiment has a cylindricity of 60 μm or less. From the viewpoint of higher shape accuracy, the cylindricity is preferably 40 μm or less.

In addition, as an index showing shape accuracy, there are circularity, coaxiality, and the like in addition to cylindricity. From the viewpoint of higher shape accuracy, the circularity is preferably 30 μm or less and the coaxiality is preferably 20 μm or less.

The cylindricity, circularity and coaxiality are measured using RONDCOM 60A manufactured by Tokyo Seimitsu Co., Ltd., under the condition of magnification: 200 times, and measurement rate (rotation): 6°/min and (vertical movement) 3 mm/sec, and filter: digital filter 2RC.

In addition, the smaller the deviation in the thickness (wall thickness) of the support (hereinafter, sometimes referred to as "thickness deviation") is, the more preferable it is. For example, the thickness deviation is preferably 30 μm or less.

The thickness deviation is a value obtained by measuring the wall thickness of the cross section of the end portion of the support at four points on a diagonal line using a point micrometer and calculating a difference between the maximum value and the minimum value.

Since the cylindricity, circularity, coaxiality, and thickness deviation having values in the above ranges may be obtained, the support of the exemplary embodiment may satisfy properties as a support for a photoreceptor.

When the photoreceptor is used in a laser printer, the oscillation wavelength of the laser is preferably from 350 nm to 850 nm and the shorter the wavelength, the better the resolution, which is preferable accordingly. The surface of the support is preferably roughened to have a center line average roughness Ra of 0.04 μm to 0.5 μm in order to prevent interference fringes from being caused in laser light irradiation when the electrophotographic photoreceptor is used in a laser printer. When Ra is 0.04 μm or more, an effect of preventing the interference is obtained. On the other hand, when Ra is 0.5 μm or less, a tendency that the image quality roughens is effectively prevented.

When incoherent light is used as a light source, the roughening for preventing interference fringes is not particularly required. However, this is more suitable for an increase in lifespan since defects are prevented from being caused by the roughness of the surface of the support.

Examples of the roughening method include a wet honing process in which an abrading agent is suspended in water to prepare a suspension and the suspension is sprayed onto the support, a centerless grinding process in which the support is pressed against a grinding stone which is rotating to perform continuous grinding, an anodic oxidation treatment, and the like.

Another example of the roughening method includes a method of forming a layer on the surface of the support by dispersing conductive or semiconductive powders in a resin without roughening the surface of the support and by roughing the surface using particles dispersed in the layer.

The roughening treatment by anodic oxidation treatment is a process of forming an oxidation film on the surface of support by anodizing the support as an anode in an electrolyte solution. Examples of the electrolyte solution include a sulfuric acid solution and an oxalic acid solution. However, the porous anodic oxide film formed by anodic oxidation as it is chemically active, easily contaminated and has a large resistance variation depending on the environment. Therefore, it is preferable to conduct a sealing treatment in which for a porous anodic oxide film, fine pores of the oxide film are sealed by cubical expansion caused by a hydration in pressurized water vapor or boiled water (to which a metallic salt such as a nickel salt may be added) to transform the anodic oxide into a more stable hydrated oxide.

For example, the thickness of the anodic oxide film is preferably from 0.3 μm to 15 μm. When the thickness is in the above range, the barrier property with respect to injection tends to be exhibited. In addition, a tendency of preventing increase in residual potential due to repeated use may be exhibited.

The surface of the support may be subjected to a treatment using an acidic treatment liquid or a boehmite treatment.

The treatment using an acidic treatment liquid is performed, for example, as follows. First, using an acidic treatment liquid formed of a phosphoric acid, a chromic acid, and a hydrofluoric acid is prepared. Regarding the blending ratio of the phosphoric acid, the chromic acid, and the hydrofluoric acid in the acidic treatment liquid, for example, the phosphoric acid is in a range of from 10% by weight to 11% by weight, the chromic acid is in range of from 3% by weight to 5% by weight, and the hydrofluoric acid is in a range of 0.5% by weight to 2% by weight. The total concentration of the acids may be in a range of from 13.5% by weight to 18% by weight. For example, the treatment temperature is preferably from 42° C. to 48° C. The thickness of the film is preferably from 0.3 μm to 15 μm.

The boehmite treatment is carried out by immersing the support in pure water at a temperature of 90° C. to 100° C. for 5 minutes to 60 minutes, or by bringing it into contact with heated water vapor at a temperature of 90° C. to 120° C. for 5 minutes to 60 minutes. The film thickness of the film is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are particularly preferable.

The specific surface area of the inorganic particles as measured by a BET method is, for example, preferably 10 $m^2/g$ or more.

The volume average particle diameter of the inorganic particles is, for example, preferably from 50 nm to 2000 nm (preferably from 60 nm to 1000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more kinds thereof.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N, N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyl triethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transport materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butydiphenoquinone.

Particularly, as the electron acceptive compound, compounds having an anthraquinone structure are preferable. As the compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The dropwise addition or spraying of the electron acceptive compound is preferably carried out at a temperature not higher than the boiling point of the solvent. After the dropwise addition or spraying of the electron acceptive compound, the inorganic particles may further be subjected to baking at a temperature of 100° C. or higher. The baking may be carried out at any temperature and time without particular limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic waves, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and time without particular limitation, in which desired electrophotographic characteristics may be obtained. In the wet method, the moisture contained in the inorganic particles may be removed prior to the addition of an electron acceptive compound, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binder resin used in the undercoat layer include known materials, such as well-known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transport resins having charge transport groups, and conductive resins (for example, polyaniline).

Among these, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins are suitable.

In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transport pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used alone, or as a mixture or a polycondensate of plural compounds.

The Vickers hardness of the undercoat layer is preferably 35 or more.

The surface roughness (ten point height of irregularities) of the undercoat layer is preferably adjusted in the range of from (¼) nλ to (½)λ, in which λ represents the wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buff polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming a coating liquid for forming an undercoat layer include known organic solvents, such as alcohol solvents, aromatic hydrocarbon solvents, hydrocarbon halide solvents, ketone solvents, ketone alcohol solvents, ether solvents, and ester solvents.

Specific examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, and a paint shaker.

Examples of a method of applying the coating liquid for forming an undercoat layer to the support include ordinary methods such as a blade coating method, a wire bar coating method, a spray coating method, a dipping coating method, a bead coating method, an air knife coating method, and a curtain coating method.

For example, the film thickness of the undercoat layer is set to be in a range of preferably from 15 μm or more, and more preferably from 20 μm to 50 μm.

Intermediate Layer

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins, polyvinyl alcohol resins, polyvinyl acetal resins (for example, polyvinylbutyral), casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organometallic compound. Examples of the organometallic compound used in the intermediate layer include organometallic compounds containing a metal atom such as zirconium, titanium, aluminum, manganese, and silicon.

These compounds used in the intermediate layer may be used alone or as a mixture or a polycondensate of plural compounds.

Among these, the intermediate layer is preferably a layer including organometallic compounds containing a zirconium atom or a silicon atom.

The formation of the intermediate layer is not particularly limited, and well-known forming methods are used.

The formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spray coating method, a blade coating method, a knife coating method, and a curtain coating method are used.

For example, the film thickness of the intermediate layer is set to be in a range of preferably from 0.1 μm to 3 μm. Further, the intermediate layer may be used as an undercoat layer.

Charge Generating Layer

The charge generating layer is a layer containing, for example, a charge generating material and a binder resin. In addition, the charge generating layer may be a layer formed by deposition using the charge generating material. The deposited layer of the charge generating material is suitable for the case in which an incoherent light source such as a Light Emitting Diode (LED), or an organic Electro-Luminescence (EL) image array is used.

Examples of the charge generating material include azo pigments such as bisazo and trisazo pigments; condensed ring aromatic pigments such as dibromoanthanthzone pigments; perylene pigments; pyrrolopyrrole pigments; phthalocyanine pigments; zinc oxides; and trigonal selenium.

Among these, in order to correspond to laser exposure in the near-infrared region, it is preferable to use metal or metal-free phthalocyanine pigments as the charge generating material, and specifically, hydroxygallium phthalocyanine; chlorogallium phthalocyanine; dichlorotin phthalocyanine; and titanyl phthalocyanine are more preferable.

On the other hand, in order to correspond to laser exposure in the near-ultraviolet region, as the charge generating material, condensed ring aromatic pigments such as dibromoanthanthrone; thioindigo pigments; porphyrazine compounds; zinc oxides; trigonal selenium; bisazo pigments are preferable.

Even when an incoherent light source such as an LED or an organic EL image array, having a light emitting center wavelength of 450 nm to 780 nm, is used, the above charge generating material may be used. However, from the viewpoint of resolution, when a thin film of 20 μm or less is used as the photosensitive layer, the field strength in the photosensitive layer is increased and a decrease in charging is caused by charges injected from the support. Thus, image defects called so-called black spots easily occur. This phenomenon becomes remarkable when a charge generating material such as trigonal selenium, a phthalocyanine pigment or the like, which is a p-type semiconductor and easily generates dark currents, is used.

In contrast, in the case where an n-type semiconductor such as a condensed ring aromatic pigment, a perylene pigment, an azo pigment, and the like is used as the charge generating material, dark currents are not easily generated, and image defects called black spots even with a thin film may be prevented. However, the n-type charge generating material is not particularly limited.

In addition, determination of the n-type is conducted by the polarity of the flowing photocurrent using a time-of-flight method that is generally used, and a type in which electrons flow more easily than holes as a carrier is taken as an n-type.

The binder resin used in the charge generating layer is selected from a wide range of insulating resins, or may be selected from organic photoconductive polymers such as poly-N-vinylcarbazole, polyvinylanthracene, polyvinylpyrene, and polysilane.

Examples of the binder resin include polyvinyl butyral resin, polyarylate resin (such as a polycondensate made from a bisphenol and an aromatic divalent carboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. The term "insulating" herein means $10^{13}$ Ωcm or more in terms of volume resistivity.

These binder resins may be used alone or as a mixture of two or more kinds thereof.

The blending ratio (weight ratio) of the charge generating material to the binder resin is preferably in the range of from 10:1 to 1:10.

In addition to the above components, the charge generating layer may contain various well-known additives.

A method of forming the charge generating layer is not particularly limited and a known forming method is used. For example, the charge generating layer is formed by forming a coating film of a coating liquid for forming a charge generating layer obtained by adding the above components to a solvent, drying the coating film, and as required, heating the film. The charge generating layer may be formed by deposition of the charge generating material. The formation of the charge generating layer by deposition is particularly suitable for the case in which a condensed ring aromatic pigment or a perylene pigment is used as the charge generating material.

Examples of the solvent for preparing the coating liquid for forming a charge generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more kinds thereof.

Examples of a method of dispersing particles (for example, charge generating material) in the coating liquid for forming a charge generating layer include methods using medium dispersing machines such as a ball mill, a vibrating ball mill, an attritor, a sand mill, and a horizontal sand mill and mediumless dispersing machines such as a stirrer, an ultrasonic wave disperser, a roll mill, and a high pressure homogenizer. Examples of the high pressure homogenizer include a collision type of dispersing a dispersion in a high pressure state through liquid-liquid collision or liquid-wall collision, and a pass-through type of dispersing a dispersion by causing the dispersion to pass through a fine flow path in a high pressure state.

At the time of the dispersion, it is effective to set the average size of the charge generating material in the coating liquid for forming a charge generating layer to be 0.5 μm or less, preferably to be 0.3 μm or less, and still preferably to be 0.15 μm or less.

Examples of a method of applying the coating liquid for forming a charge generating layer to the undercoat layer (or the intermediate layer) include ordinary methods such as blade coating method, a wire-bar coating method, a spray coating method, a dipping coating method, a bead coating method, an air knife coating method, and a curtain coating method.

For example, the film thickness of the charge generating layer is preferably from 0.1 μm to 5.0 μm and more preferably from 0.2 μm to 2.0 μm.

Charge Transporting Layer

The charge transporting layer is a layer containing, for example, a charge transporting material and a binder resin. The charge transporting layer may be a layer containing a polymeric charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, arylalkane compounds, aryl-substituted ethylene compounds, stilbene compounds, anthracene compounds, and hydrazone compounds. These charge transporting materials are used alone or as a mixture of two or more kinds but are not limited thereto.

As the charge transporting material, a triarylamine derivative represented by the following formula (a-1) and a benzidine derivative represented by the following formula (a-2) are preferable from the viewpoint of charge mobility.

(a-1)

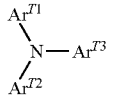

In the formula (a-1), $Ar^{T1}$, $Ar^{T2}$ and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$ and $R^{T8}$ each independently represent a hydrogen atom, a substituted or unsubstituted alkyl group, or a substituted or unsubstituted aryl group.

Examples of a substituent of the above respective groups include a halogen atom, an alkyl group having from 1 to 5 carbon atoms, an alkoxy group having from 1 to 5 carbon atoms, and a substituted amino group substituted with an alkyl group having from 1 to 3 carbon atoms.

(a-2)

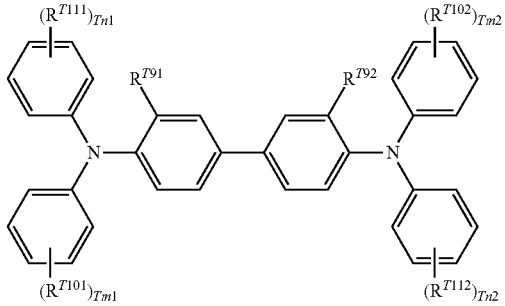

In the formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms. $R^{T101}$, $R^{T102}$, $R^{T111}$ and $R^{T112}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer from 0 to 2.

Examples of a substituent of the above respective groups include a halogen atom, an alkyl group having from 1 to 5 carbon atoms, and an alkoxy group having from 1 to 5 carbon atoms. In addition, another example of a substituent of the above respective groups includes a substituted amino group substituted with an alkyl group having from 1 to 3 carbon atoms.

Here, among the triarylamine derivative represented by the formula (a-1) and the benzidine derivative represented by the formula (a-2), particularly, the triarylamine derivative having "$—C_6H_4—CH=CH—CH=C(R^{T7})(R^{T8})$" and the benzidine derivative having "$—CH=CH—CH=C(R^{T15})(R^{T16})$" are preferable from the viewpoint of charge mobility.

As the polymeric charge transporting material, well-known polymeric compounds having a charge transporting property such as poly-N-vinylcarbazole, and polysilane are used. Particularly, polyester polymeric charge transporting materials are particularly preferable. The polymeric charge transporting materials may be used alone or in combination with a binder resin.

Examples of the binder resin used for the charge-transporting layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinyl carbazole, and polysilane. Among these, as the binder resin, a polycarbonate resin or a polyarylate resin is suitable. These binder resins may be used alone or as a mixture of two or more kinds thereof.

The blending ratio (weight ratio) of the charge transporting material to the binder resin is preferably from 10:1 to 1:5.

The charge transporting layer may contain known additives in addition to the above components.

A method of forming the charge transporting layer is not particularly limited and a known forming method is used. For example, the charge transporting layer is formed by forming a coating film of a coating liquid for forming a charge transporting layer obtained by adding the above components to a solvent, drying the coating film, and as required, heating the film.

Examples of the solvent for preparing the coating liquid for forming a charge transporting layer include ordinary organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or as a mixture of two or more kinds thereof.

Examples of a coating method used when the coating liquid for forming a charge transporting layer is applied to the charge generating layer include ordinary methods such as a blade coating method, a wire bar coating method, a spray coating method, a dipping coating method, a bead coating method, an air knife coating method, or a curtain coating method.

For example, the film thickness of the charge transporting layer is set to be in a range of preferably from 5 μm to 50 μm and more preferably from 10 μm to 30 μm.

Protective Layer

The protective layer is provided on the photosensitive layer as required. The protective layer is provided to, for example, prevent chemical changes of the photosensitive layer when being charged, or to further improve the mechanical strength of the photosensitive layer.

Therefore, as the protective layer, layers including a cured film (crosslinked film) may be preferably applied. Examples of these layers include layers shown in the following 1) and 2).

1) A layer including a cured film of a composition including a reactive group-containing charge transporting material having a reactive group and a charge transporting skeleton in the same molecule (that is, layer including a polymer or a cross linked product of the reactive group-containing charge transporting material), and 2) A layer including a cured film of a composition including a non-reactive charge transporting material and a reactive group-containing non-charge transporting material having a reactive group without having a charge transporting skeleton, (that is, a layer including a non-reactive charge transporting material and a polymer or a crosslinked product of the reactive group-containing non-charge transporting material).

Examples of the reactive group of the reactive group-containing charge transporting material include known reactive groups such as a chain polymerizable group, an epoxy group, —OH, —OR [wherein, R represents an alkyl group], $—NH_2$, —SH, —COOH, and $—SiR^{Q1}{}_{3-Qn}(OR^{Q2})_{Qn}$ [wherein, $R^{Q1}$ represents a hydrogen atom, an alkyl group, or substituted or unsubstituted aryl group, and $R^{Q2}$ represents a hydrogen atom, an alkyl group, or a trialkylsilyl group. On represents an integer from 1 to 3.].

The chain polymerizable group is not particularly limited as long as the group is a radical polymerizable functional group. For example, the chain polymerizable group is a functional group having a group containing at least a carbon double bond. Specific examples thereof include a group containing at least one selected from a vinyl group, a vinyl ether group, a vinyl thioether group, a styryl group, an acryloyl group, a methacryloyl group, and derivatives thereof. Among these, from the viewpoint of excellent reactivity, as the chain polymerizable group, a group containing at least one selected from a vinyl group, a styryl group, an acryloyl group, a methacryloyl group, and derivatives thereof is preferable.

The charge transporting skeleton of the reactive group-containing charge transporting material is not particularly limited as long as the skeleton has a known structure in the electrophotographic photoreceptor. Examples thereof include a skeleton derived from a nitrogen-containing hole transporting compound such as a triarylamine compound, and a benzidine compound, a hydrozone compound, in which the structure is conjugated with a nitrogen atom. Among these, a triarylamine skeleton is preferable.

The reactive group-containing charge transporting material having a reactive group and a charge transporting skeleton, the non-reactive charge transporting material, and the reactive group-containing non-charge transporting material may be selected from known materials.

The protective layer may contain known additives in addition to the above component.

A method of forming the protective layer is not particularly limited and a known forming method is used. For example, the protective layer is formed by forming a coating film of a coating liquid for forming a protective layer obtained by adding the above components in a solvent, drying the coating film, and as required, curing the coating film by heating or the like.

Examples of the solvent for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monoethyl ether; and alcohol solvents such as isopropyl alcohol and butanol. These solvents may be used alone or as a mixture of two or more kinds thereof.

The coating liquid for forming a protective layer may be solvent-free.

Examples of a method of applying the coating liquid for forming a protective layer to the photosensitive layer (for example, charge transporting layer) include ordinary methods such as a dipping coating method, an extrusion coating method, a wire bar coating method, a spray coating method, a blade coating method, a knife coating method, and a curtain coating method.

For example, the film thickness of the protective layer is set to be in a range of preferably from 1 μm to 20 μm and more preferably from 2 μm to 10 μm.

Single Layer Type Photosensitive Layer

The single layer type photosensitive layer (charge generating and charge transporting layer) is a layer containing, for example, a charge generating material and a charge transporting material, and a binder resin and other known additives as required. These materials are the same materials as those described in the materials of the charge generating layer and the charge transporting layer.

The content of the charge generating material in the single layer type photosensitive layer may be from 10% by weight to 85% by weight and is preferably from 20% by weight to 50% by weight with respect to the total solid content. In addition, the content of the charge transporting material in the single layer type photosensitive layer may be from 5% by weight to 50% by weight with respect to the total solid content.

A method of forming the single layer type photosensitive layer is the same as the method of forming the charge generating layer and the charge transporting layer.

For example, the film thickness of the single layer type photosensitive layer may be from 5 μm to 50 μm and is preferably from 10 μm to 40 μm.

Image Forming Apparatus (and Process Cartridge)

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of the charged electrophotographic photoreceptor, a developing unit that develops the electrostatic latent image formed on the surface of the electrophotographic photoreceptor by a developer including a toner to form a toner image, and a transfer unit that transfers the toner image onto a surface of a recording medium. Further, the electrophotographic photoreceptor according to the present exemplary embodiment is applied as the electrophotographic photoreceptor.

As the image forming apparatus of the exemplary embodiment, known image forming apparatuses such as an apparatus including a fixing unit that fixes a toner image transferred onto a surface of a recording medium; a direct transfer type apparatus in which a toner image, formed on a surface of an electrophotographic photoreceptor is directly transferred onto a recording medium; an intermediate transfer type apparatus in which a toner image, formed on a surface of an electrophotographic photoreceptor, is primarily transferred onto a surface of an intermediate transfer medium, and the toner image, transferred onto the surface of the intermediate transfer medium, is secondarily transferred onto a surface of a recording medium; an apparatus including a cleaning unit that cleans, after transferring a toner image, a surface of an electrophotographic photoreceptor before charging; an apparatus including an erasing unit that irradiates, after transferring a toner image, a surface of an image holding member with erasing light to perform erasing before charging; and an apparatus including an electrophotographic photoreceptor heating member for increasing the temperature of an electrophotographic photoreceptor and reducing a relative temperature may be applied.

In the case of the intermediate transfer type device, for the transfer unit, for example, a configuration which includes an intermediate transfer member to the surface of which the toner image is transferred, a first transfer unit that primarily transfers a toner image formed on the surface of an image holding member to the surface of the intermediate transfer member, and a secondary transfer unit that secondarily transfers the toner image transferred to the surface of the intermediate transfer member on the surface of the recording medium, is applied.

The image forming apparatus according to the present exemplary embodiment may be any one of a dry development type image forming apparatus and a wet development type (development type using a liquid developer) image forming apparatus.

Furthermore, in the image forming apparatus according to the present exemplary embodiment, for example, a part provided with the electrophotographic photoreceptor may be a cartridge structure (process cartridge) that is detachable from an image forming apparatus. As the process cartridge, for example, a process cartridge including the electrophotographic photoreceptor according to the present exemplary embodiment is suitably used. Further, the process cartridge may include, in addition to the electrophotographic photoreceptor, for example, at least one selected from the group consisting of a charging unit, an electrostatic latent image forming unit, a developing unit, and a transfer unit.

Hereinafter, one example of the image forming apparatuses according to the present exemplary embodiment is shown, but the present invention is not limited thereto. Further, the main parts shown in the figures are described, and explanation of the others will be omitted.

Figure 8:
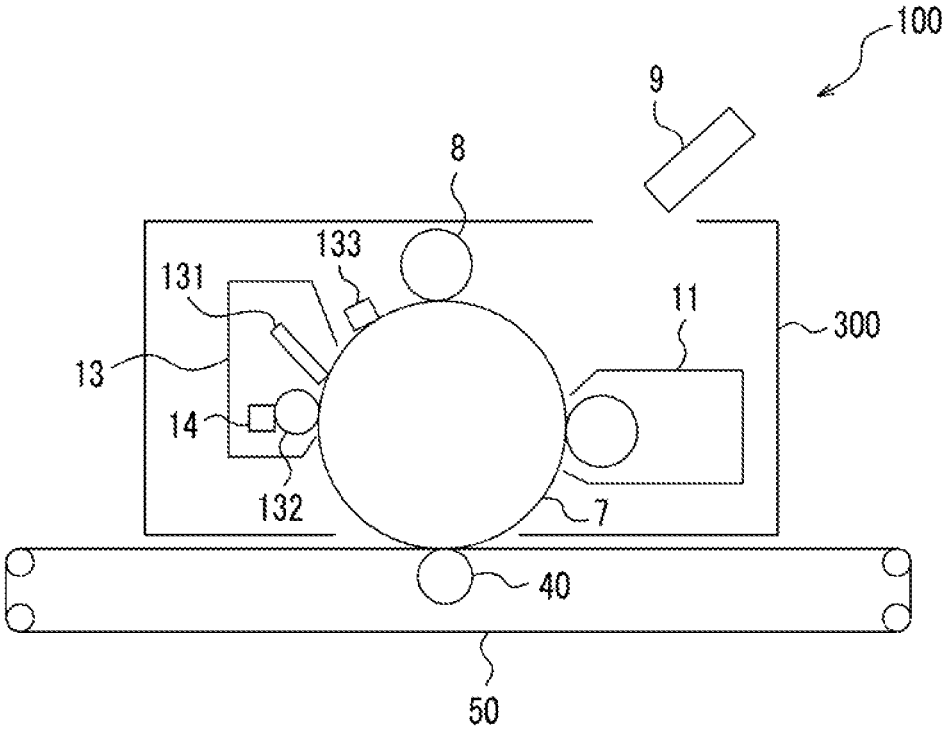
FIG. 8 is a diagram schematically illustrating the configuration of an example of an image forming apparatus according to the exemplary embodiment.

FIG. 8 is a diagram schematically illustrating the configuration of an example of an image forming apparatus according to the exemplary embodiment.

As shown in FIG. 8, an image forming apparatus 100 according to the exemplary embodiment is provided with a process cartridge 300 provided with an electrophotographic photoreceptor 7, an exposure device 9 (an example of the electrostatic latent image forming unit), a transfer device 40 (primary transfer device), and an intermediate transfer member 50. In the image forming apparatus 100, the exposure device 9 is provided at a position where it is possible to expose the electrophotographic photoreceptor 7 from an opening portion of the process cartridge 300, the transfer device 40 is provided at such a position as to be opposed to the electrophotographic photoreceptor 7 with the intermediate transfer member 50 interposed therebetween, and the intermediate transfer member 50 is provided so as to be partially brought into contact with the electrophotographic photoreceptor 7. Although not shown, a secondary transfer unit that transfers the toner image transferred to the intermediate transfer member 50 to a recording medium (for example, paper) is also provided. The intermediate transfer member 50, the transfer device 40 (primary transfer device), and the secondary transfer device (not shown) correspond to an example of the transfer unit.

The process cartridge 300 in FIG. 8 supports the electrophotographic photoreceptor 7, a charging device 8 (an example of the charging unit), a developing device 11 (an example of the developing unit), and a cleaning device 13 (an example of the cleaning unit) integrally in a housing. The cleaning device 13 has a cleaning blade 131 (an example of a cleaning member), and the cleaning blade 131 is provided to be brought into contact with the surface of the electrophotographic photoreceptor 7. The cleaning member may be conductive or insulating fibrous members instead of the form of the cleaning blade 131 and the fibrous members may be used alone or maybe used together with the cleaning blade 131.

In FIG. 8, as the image forming apparatus, an example using a fibrous member 132 (roll shape) which supplies a lubricant 14 to the surface of the electrophotographic photoreceptor 7 and a fibrous member 133 (flat brush) which assists the cleaning is shown. However, these may be provided as required.

Hereinafter, the respective configurations of the image forming apparatus according to the present exemplary embodiment will be described.

Charging Device

As the charging device 8, for example, a contact type charging device using a conductive or semiconductive charging roll, a charging brush, a charging film, a charging rubber blade, a charging tube, or the like is used. Further, known charging devices, such as a non-contact type roller charging device, and a scorotron charging device and a corotron charging device, each using corona discharge, and the like are also used.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity wavelengths of the electrophotographic photoreceptor. As the semiconductor lasers, near infrared lasers having oscillation wavelengths near 780 nm are predominant. However, the wavelength of the laser ray to be used is not limited to such a wavelength, and a laser having an oscillation wavelength of 600 nm range, or a laser having any oscillation wavelength in the range of from 400 nm to 450 nm may be used as a blue laser. In order to form a color image, it is also effective to use a surface emitting laser light source capable of attaining a multi-beam output.

Developing Device

As the developing device 11, for example, a common developing device, in which a developer is contacted or not contacted for forming an image, may be used. Such a developing device 11 is not particularly limited as long as it has the above-described functions, and may be appropriately selected according to the intended use. Examples thereof include a known developing device in which the single-component or two-component developer is adhered to the electrophotographic photoreceptor 7 using a brush or a roller. Among these, the developing device using a developing roller holding a developer on the surface thereof is preferable.

The developer used in the developing device 11 may be a single-component developer formed of a toner alone or a two-component developer formed of a toner and a carrier. Further, the developer may be magnetic or non-magnetic. As the developer, known ones may be applied.

Cleaning Device

As the cleaning device 13, a cleaning blade type device provided with the cleaning blade 131 is used.

Further, in addition to the cleaning blade type, a fur brush cleaning type and a type of a device which performs developing and cleaning at once may also be employed.

Transfer Device

Examples of the transfer device 40 include known transfer charging devices, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 9:
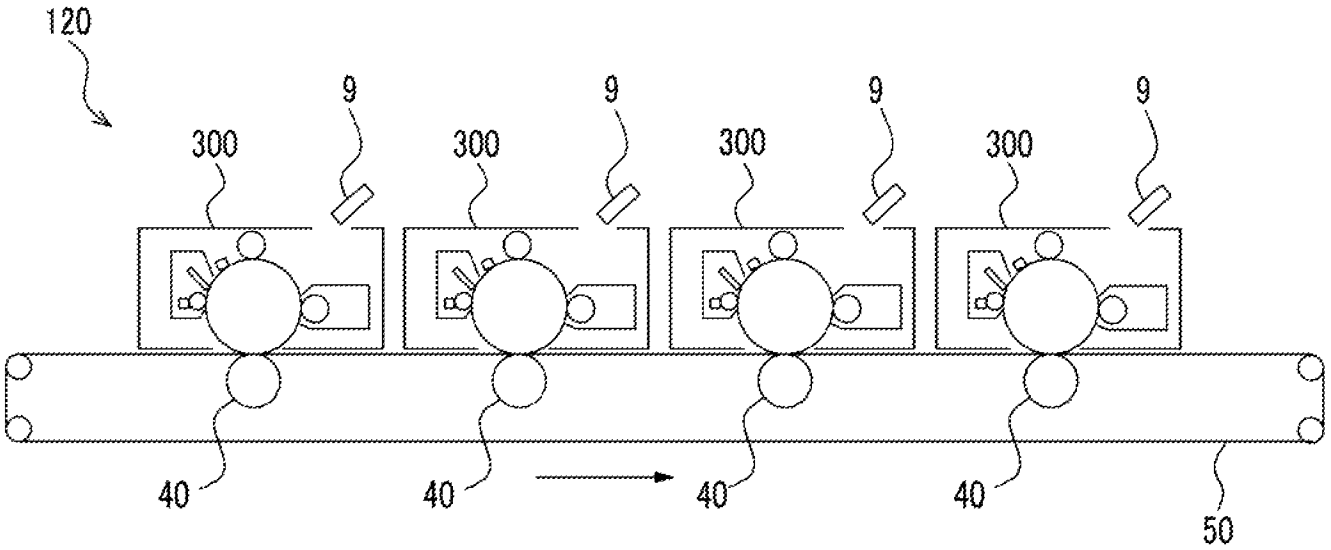
FIG. 9 is a diagram schematically illustrating the configuration of another example of the image forming apparatus according to the exemplary embodiment.

FIG. 9 is a diagram schematically illustrating the configuration of another example of the image forming apparatus according to the exemplary embodiment.

An image forming apparatus 120 shown in FIG. 9 is a tandem-type multicolor image forming apparatus having four process cartridges 300. In the image forming apparatus 120, the four process cartridges 300 are provided in parallel to each other on an intermediate transfer member 50, and one electrophotographic photoreceptor is used for one color. The image forming apparatus 120 has the same configuration as that of the image forming apparatus 100, except for being a tandem type.

EXAMPLES

Hereinafter, Examples of the present invention will be described, but the present invention is not limited to the following Examples. In the following description, "parts" and "%" each refer to an amount on a weight basis unless otherwise specified.

Example 1

Preparation of Support 1

A slag of an aluminum alloy coated with a lubricant ("component composition" Si: 0.5% by weight, Fe: 0.6% by weight, Cu: 0.2% by weight, Mn: 0.1% by weight, Mg: 1.0% by weight, Cr: 0.1% by weight, Zn: 0.2% by weight, Ti: 0.05% by weight, and a balance: aluminum and unavoidable impurities) is prepared. Using the slag, impact pressing is performed by a die (female die) and a punch (male die) to prepare a Φ32 mm cylindrical molded product.

Next, the cylindrical molded product molded by the impact pressing is heated under a temperature condition of 350° C. for 0.5 hours and then cooled for solution treatment.

Next, the solution-treated cylindrical molded product is subjected to ironing once to correct the shape.

Then, the shape-corrected cylindrical molded product is heated to 300° C. and kept for 1 hour for age-hardening. Thus, a support 1 is prepared.

Examples 2 to 12 and Comparative Examples 1 to 6

Preparation of Supports 2 to 18

Supports 2 to 18 are prepared in the same manner as in the case of the support 1, except that aluminum alloys having component compositions shown in Table 1 are used and the support preparation conditions are changed as shown in Table 2.

Comparative Examples 7 and 8

Preparation of Supports 19 and 20

Φ30 mm supports 19 and 20 are prepared by cutting the surfaces of cylindrical molded products prepared by using aluminum alloys having component compositions shown in Table 1 through conventional extruding and drawing working.

Comparative Example 9

Preparation of Support 21

A Φ30 am support 21 is prepared by cutting the surface of a cylindrical molded product prepared by using the aluminum alloy having the same component composition of Example 1 through conventional extruding and drawing working.

Comparative Example 10

An attempt to prepare a support having a wall thickness of 0.3 mm is made by subjecting the aluminum alloy having the same component composition as that of Example 1 to impact pressing and then to ironing once without solution treatment. However, a support having a desired shape cannot be obtained.

The shape of each of the supports prepared in the respective examples (cylindricity, circularity, coaxiality, thickness deviation, average area of crystal grains, and wall thickness) is measured by the above-described methods. The measurement results are shown in Table 3.

Preparation of Electrophotographic Photoreceptor

The supports prepared in the respective examples are used to prepare electrophotographic photoreceptors by the following method.

Formation of Undercoat Layer 100 parts by weight of a zinc oxide (average particle diameter: 70 nm, manufactured by Tayca Corporation, specific surface area value: 15 $m^2/g$) is mixed and stirred with 500 parts by weight of tetrahydrofuran, and 1.3 parts by weight of a silane coupling agent (KBM503, manufactured by Shin-Etsu Chemical Co., Ltd.) is added thereto and the resultant is stirred for 2 hours. Thereafter, the tetrahydrofuran is distilled away by distillation under reduced pressure and baking is performed at 120° C. for 3 hours to obtain a zinc oxide surface-treated with the silane coupling agent.

110 parts by weight of the surface-treated zinc oxide is mixed and stirred with 500 parts by weight of tetrahydrofuran, and a solution obtained by dissolving 0.6 parts by weight of alizarin in 50 parts by weight of tetrahydrofuran is added thereto and the resultant is stirred for 5 hours at 50° C. Thereafter, the alizarin-imparted zinc oxide is filtered by filtration under reduced pressure and dried under reduced pressure at 60° C. to obtain an alizarin-imparted zinc oxide.

38 parts by weight of a solution obtained by dissolving 60 parts by weight of the alizarin-imparted zinc oxide, 13.5 parts by weight of a curing agent (blocked isocyanate SUMIDUR 3175, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethyl ketone. The mixture is dispersed for 2 hours with a sand mill using 1 mmϕ glass beads to obtain a dispersion.

To the obtained dispersion, 0.005 parts by weight of dioctyltin dilaurate and 45 parts by weight of silicone resin particles (TOSPEARL 145, manufactured by Momentive Performance Materials Inc.) are added as catalysts, and thereby a coating liquid for undercoat layer formation is obtained. The coating liquid for forming an undercoat layer is applied to the above-described respective supports prepared in the respective examples through a dipping coating method, and cured by drying at 170° C. for 30 minutes, and thereby an undercoat layer having a film thickness of 23 μm is obtained.

Formation of Charge Generating Layer 1 part by weight of hydroxygallium phthalocyanine having strong diffraction peaks at Bragg angles (2θ±0.2°) of 7.5°, 9.9°, 12.5°, 16.3°, 18.6°, 25.1°, and 28.3° in an X-ray diffraction spectrum is mixed with 1 part by weight of polyvinyl butyral (S-LEC BM-S, manufactured by Sekisui Chemical Co., Ltd.) and 80 parts by weight of n-butyl acetate to obtain a liquid mixture. This liquid mixture is dispersed for 1 hour using a paint shaker with glass beads to prepare a coating liquid for forming a charge generating layer. The obtained coating liquid for forming a charge generating layer is dip-coated on the formed undercoat layer, and heated and dried for 10 minutes at 100° C. to form a charge generating layer having a film thickness of 0.15 μm.

Formation of Charge Transporting Layer

A coating liquid for forming a charge transporting layer is prepared by dissolving 2.6 parts by weight of a benzidine compound represented by the following formula (CT-1) and 3 parts by weight of a polymer compound (viscosity average molecular weight: 40,000) having repeating units represented by the following formula (B-1) in 25 parts by weight of THF. The obtained coating liquid for forming a charge transporting layer is coated on the above-described charge generating layer through a dipping coating method and heating is performed thereon for 45 minutes at 130° C. to form a charge transporting layer having a film thickness of 20 μm.

(CT-1)

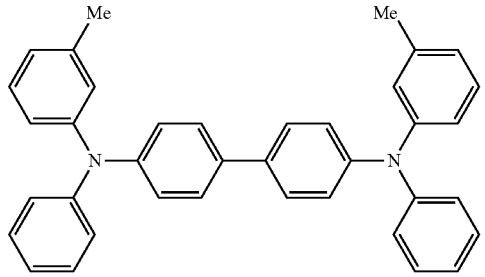

(B-1)

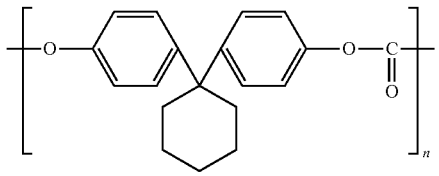

Evaluation

Drop Test

The photoreceptors prepared in Examples and Comparative Examples are mounted on a process cartridge of a color image forming apparatus (manufactured by Fuji Xerox Co., Ltd., DocuPrint C1100) and are allowed to collide with a floor surface by free drop from a drop height of 1.5 m from the floor surface.

Regarding the deformation of the support after the drop, the circularity is measured using RONDCOM 60A manufactured by Tokyo Seimitsu Co., Ltd. and visually confirmed.

Thereafter, these are mounted on a printer to print images having a half-tone density of 50% (image having a low density image quality) to A4 paper (manufactured by Fuji Xerox Co., Ltd., C2 paper). Then, a letter image having an area coverage (ratio of area occupied by letters in A4 paper) of 2% is printed on 20,000 pieces of A4 paper (manufactured by Fuji Xerox Co., Ltd., C2 paper) to confirm the image and problems in practical use.

The results are shown in Table 3.

Deformation

A: There is no change in circularity and there are no problems.

B: There are no problems in practical use even with a deterioration in circularity by 30 μm or less as compared with that before the drop.

C: There are no problems in practical use even with a deterioration in circularity by more than 30 μm to 100 μm as compared with that before the drop.

D: The circularity deteriorates by more than 100 μm as compared with that before the drop.

Image Quality

A: There are no problems.

B: There are no problems in practical use even with a change in image density.

C: An obvious reduction in image density is caused in the image after printing of 20,000 pieces of paper.

D: Voids due to deformation are caused from the first piece of paper printed.

TABLE 1

| | | Aluminum alloy component composition (% by weight) [Balance: Al and impurities] | | | | | | | |
|---|---|---|---|---|---|---|---|---|---|
| | Support No. | Si | Fe | Cu | Mn | Mg | Cr | Zn | Ti |
| Example-1 | Support 1 | 0.5 | 0.6 | 0.2 | 0.1 | 1.0 | 0.1 | 0.2 | 0.05 |
| Example-2 | Support 2 | 0.7 | 0.4 | 0.35 | 0.15 | 0.8 | 0.15 | 0.15 | 0.15 |
| Example-3 | Support 3 | 0.8 | 0.3 | 0.15 | 0.12 | 1.2 | 0.3 | 0.1 | 0.1 |
| Example-4 | Support 4 | 0.4 | 0.7 | 0.23 | 0.07 | 1.1 | 0.05 | 0.05 | 0.07 |
| Example-5 | Support 5 | 0.6 | 0.5 | 0.35 | 0.05 | 0.9 | 0.08 | 0.25 | 0.12 |
| Example-6 | Support 6 | 0.8 | 0.2 | 0.17 | 0.14 | 0.8 | 0.12 | 0.05 | 0.08 |
| Example-7 | Support 7 | 0.4 | 0.5 | 0.4 | 0.1 | 1.1 | 0.2 | 0.15 | 0.14 |
| Example-8 | Support 8 | 0.6 | 0.7 | 0.2 | 0.08 | 1.0 | 0.18 | 0.1 | 0.06 |
| Example-9 | Support 9 | 0.7 | 0.3 | 0.22 | 0.06 | 1.2 | 0.25 | 0.25 | 0.1 |
| Example-10 | Support 10 | 0.5 | 0.4 | 0.37 | 0.12 | 0.9 | 0.22 | 0.2 | 0.11 |
| Example-11 | Support 11 | 0.5 | 0.6 | 0.15 | 0.1 | 1.1 | 0.35 | 0.15 | 0.14 |
| Example-12 | Support 12 | 0.7 | 0.2 | 0.25 | 0.07 | 1.0 | 0.17 | 0.1 | 0.07 |
| Comparative Example-1 | Support 13 | 0.1 | 0.05 | 0.02 | 0.01 | 0.03 | — | 0.01 | 0.02 |
| Comparative Example-2 | Support 14 | 0.2 | 0.15 | 0.03 | 0.02 | 0.01 | — | 0.03 | 0.01 |
| Comparative Example-3 | Support 15 | 0.05 | 0.1 | 0.01 | 0.03 | 0.02 | — | 0.02 | 0.03 |
| Comparative Example-4 | Support 16 | 0.05 | 0.1 | 0.04 | 0.02 | 0.01 | — | 0.03 | 0.01 |
| Comparative Example-5 | Support 17 | 0.15 | 0.05 | 0.03 | 0.01 | 0.02 | — | 0.02 | 0.03 |
| Comparative Example-6 | Support 18 | 0.2 | 0.1 | 0.02 | 0.03 | 0.03 | — | 0.01 | 0.02 |
| Comparative Example-7 | Support 19 | 0.1 | 0.15 | 0.01 | 0.01 | 0.02 | — | 0.02 | 0.03 |
| Comparative Example-8 | Support 20 | 0.15 | 0.1 | 0.03 | 0.02 | 0.01 | — | 0.03 | 0.01 |
| Comparative Example-9 | Support 21 | 0.5 | 0.6 | 0.2 | 0.1 | 1.0 | 0.1 | 0.2 | 0.05 |

TABLE 2

| | | Support preparation process | | | |
|---|---|---|---|---|---|
| | Support No. | First working process | Solution treatment process | Second working process | Age-hardening treatment process |
| Example-1 | Support 1 | Impact pressing | 350° C. × 0.5 hours | Ironing × 1 time | 300° C. × 1.0 hour |
| Example-2 | Support 2 | Impact pressing | 350° C. × 1.0 hour | Ironing × 2 times | 200° C. × 2.0 hours |
| Example-3 | Support 3 | Impact pressing | 350° C. × 2.0 hours | Ironing × 2 times | 100° C. × 3.0 hours |
| Example-4 | Support 4 | Impact pressing | 450° C. × 0.5 hours | Ironing × 2 times | 300° C. × 1.0 hour |
| Example-5 | Support 5 | Impact pressing | 450° C. × 1.0 hour | Ironing × 2 times | 200° C. × 2.0 hours |
| Example-6 | Support 6 | Impact pressing | 450° C. × 2.0 hours | Ironing × 2 times | 100° C. × 3.0 hours |
| Example-7 | Support 7 | Impact pressing | 550° C. × 0.5 hours | Ironing × 3 times | 300° C. × 1.0 hour |
| Example-8 | Support 8 | Impact pressing | 550° C. × 1.0 hour | Ironing × 2 times | 200° C. × 2.0 hours |
| Example-9 | Support 9 | Impact pressing | 550° C. × 2.0 hours | Ironing × 2 times | 100° C. × 3.0 hours |
| Example-10 | Support 10 | Impact pressing | 600° C. × 0.5 hours | Ironing × 2 times | 300° C. × 1.0 hour |
| Example-11 | Support 11 | Impact pressing | 600° C. × 1.0 hour | Ironing × 3 times | 200° C. × 2.0 hours |
| Example-12 | Support 12 | Impact pressing | 600° C. × 2.0 hours | Ironing × 3 times | 100° C. × 3.0 hours |
| Comparative Example-1 | Support 13 | Impact pressing | None | Ironing × 1 time | None |
| Comparative Example-2 | Support 14 | Impact pressing | None | Ironing × 2 times | None |

TABLE 2-continued

| | | Support preparation process | | | |
|---|---|---|---|---|---|
| | Support No. | First working process | Solution treatment process | Second working process | Age-hardening treatment process |
| Comparative Example-3 | Support 15 | Impact pressing | None | Ironing × 3 times | None |
| Comparative Example-4 | Support 16 | Impact pressing | None | Ironing × 1 time | None |
| Comparative Example-5 | Support 17 | Impact pressing | None | Ironing × 2 times | None |
| Comparative Example-6 | Support 18 | Impact pressing | None | Ironing × 3 times | None |
| Comparative Example-7 | Support 19 | Drawing + cutting | None | 0 | None |
| Comparative Example-8 | Support 20 | Drawing + cutting | None | 0 | None |
| Comparative Example-9 | Support 21 | Drawing + cutting | None | 0 | None |

TABLE 3

| | | Support shape (after second working process) | | | Support shape (after age-hardening treatment) | | | | | | Evaluation | |
|---|---|---|---|---|---|---|---|---|---|---|---|---|
| | Support No. | Cylindricity (μm) | Circularity (μm) | Coaxiality (μm) | Cylindricity (μm) | Circularity (μm) | Coaxiality (μm) | Thickness deviation (μm) | Crystal grain ($\mu m^2$) | Wall thickness (mm) | Deformation | Image quality |
| Example-1 | Support 1 | 83.0 | 47.0 | 30.0 | 52.0 | 28.0 | 18.0 | 27.0 | 95.0 | 0.4 | A | A |
| Example-2 | Support 2 | 105.0 | 56.0 | 35.0 | 43.0 | 25.0 | 15.0 | 25.0 | 42.0 | 0.45 | A | A |
| Example-3 | Support 3 | 145.0 | 76.0 | 46.0 | 38.0 | 24.0 | 14.0 | 23.0 | 17.0 | 0.2 | B | B |
| Example-4 | Support 4 | 155.0 | 78.0 | 51.0 | 34.0 | 23.0 | 12.0 | 21.0 | 81.0 | 0.7 | A | A |
| Example-5 | Support 5 | 78.0 | 43.0 | 27.0 | 30.0 | 20.0 | 11.0 | 18.0 | 52.0 | 0.5 | A | A |
| Example-6 | Support 6 | 98.0 | 51.0 | 30.0 | 27.0 | 18.0 | 8.0 | 12.0 | 11.0 | 0.15 | B | B |
| Example-7 | Support 7 | 137.0 | 67.0 | 38.0 | 23.0 | 17.0 | 9.0 | 15.0 | 75.0 | 0.6 | A | A |
| Example-8 | Support 8 | 153.0 | 75.0 | 48.0 | 20.0 | 14.0 | 7.0 | 10.0 | 31.0 | 0.4 | A | A |
| Example-9 | Support 9 | 85.0 | 48.0 | 31.0 | 18.0 | 11.0 | 4.0 | 8.0 | 4.0 | 0.05 | B | B |
| Example-10 | Support 10 | 102.0 | 55.0 | 33.0 | 17.0 | 12.0 | 6.0 | 6.0 | 61.0 | 0.5 | A | A |
| Example-11 | Support 11 | 143.0 | 73.0 | 45.0 | 15.0 | 10.0 | 5.0 | 7.0 | 23.0 | 0.3 | B | A |
| Example-12 | Support 12 | 158.0 | 83.0 | 54.0 | 12.0 | 7.0 | 3.0 | 5.0 | 8.0 | 0.1 | B | B |
| Comparative Example-1 | Support 13 | 80.0 | 45.0 | 28.0 | 80.0 | 45.0 | 28.0 | 35.0 | 80.0 | 0.8 | C | C |
| Comparative Example-2 | Support 14 | 100.0 | 53.0 | 32.0 | 100.0 | 53.0 | 32.0 | 38.0 | 55.0 | 0.5 | D | C |
| Comparative Example-3 | Support 15 | 140.0 | 71.0 | 43.0 | 140.0 | 71.0 | 43.0 | 42.0 | 21.0 | 0.4 | D | D |
| Comparative Example-4 | Support 16 | 94.0 | 49.0 | 30.0 | 94.0 | 49.0 | 30.0 | 37.0 | 88.0 | 0.8 | D | D |
| Comparative Example-5 | Support 17 | 109.0 | 54.0 | 33.0 | 109.0 | 54.0 | 33.0 | 40.0 | 61.0 | 0.5 | D | D |
| Comparative Example-6 | Support 18 | 155.0 | 83.0 | 67.0 | 155.0 | 83.0 | 67.0 | 51.0 | 35.0 | 0.45 | D | D |
| Comparative Example-7 | Support 19 | 95.0 | 46.0 | 27.0 | 35.0 | 28.0 | 18.0 | 15.0 | 133.0 | 0.6 | C | C |
| Comparative Example-8 | Support 20 | 122.0 | 63.0 | 38.0 | 30.0 | 23.0 | 16.0 | 22.0 | 175.0 | 0.8 | C | C |
| Comparative Example-9 | Support 21 | 85.0 | 47.0 | 30.0 | 25.0 | 15.0 | 14.0 | 18.0 | 123.0 | 0.5 | C | C |

In Tables 1 to 3, the term "crystal grain" refers to "the average area of crystal grains".

From the above results, it is found that the measurement results of each shape are satisfactory in Examples, compared to Comparative Examples. In addition, it is found that the evaluation results of deformation and image quality are good in Examples, compared to Comparative Examples. Therefore, it is found that even when the thickness is small, high strength and high shape accuracy are achieved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cylindrical support for an electrophotographic photoreceptor comprising:

an aluminum alloy consisting essentially of

Si: 0.4% by weight to 0.8% by weight,

Fe: 0.7% by weight or less,

Cu: 0.15% by weight to 0.4% by weight,

Mn: 0.15% by weight or less,

Mg: 0.8% by weight to 1.2% by weight,

Cr: 0.04% by weight to 0.35% by weight,

Zn: 0.25% by weight or less,

Ti: 0.15% by weight or less, and a balance: aluminum and impurities, wherein an average area of crystal grains of the aluminum alloy is from 3.0 $\mu m^2$ to 100 $\mu m^2$.

2. The cylindrical support for an electrophotographic photoreceptor according to claim 1, which is prepared by:

performing cold impact pressing on the aluminum alloy to obtain a molded product, performing solution treatment on the molded product obtained in the cold impact pressing, performing shape machining on the solution-treated molded product, and performing age-hardening treatment on the shape-machined molded product.

3. The cylindrical support for an electrophotographic photoreceptor according to claim 1, wherein the cylindrical support for an electrophotographic photoreceptor has a thickness of from 0.03 mm to 1.5 mm.

4. The cylindrical support for an electrophotographic photoreceptor according to claim 1, wherein the cylindrical support for an electrophotographic photoreceptor has a thickness of from 0.1 mm to 0.9 mm.

5. The cylindrical support for an electrophotographic photoreceptor according to claim 1, wherein the cylindrical support for an electrophotographic photoreceptor has a thickness of from 0.2 mm to 0.8 mm.

6. The cylindrical support for an electrophotographic photoreceptor according to claim 1, wherein the average area of crystal grains is from 5.0 $\mu m^2$ to 80 $\mu m^2$.

7. The cylindrical support for an electrophotographic photoreceptor according to claim 1, wherein the average area of crystal grains is from 7.0 $\mu m^2$ to 70 $\mu m^2$.

8. An electrophotographic photoreceptor comprising:

the cylindrical support for an electrophotographic photoreceptor according to claim 1; and a photosensitive layer that is provided on the cylindrical support for an electrophotographic photoreceptor.

9. A process cartridge, which is detachable from an image forming apparatus and comprises the electrophotographic photoreceptor according to claim 8.

10. An image forming apparatus comprising:

the electrophotographic photoreceptor according to claim 8;

a charging unit that charges a surface of the electrophotographic photoreceptor;

an electrostatic latent image forming unit that forms an electrostatic latent image on the surface of the charged electrophotographic photoreceptor;

a developing unit that develops the electrostatic latent image formed on the surface of the electrophotographic photoreceptor by a developer including a toner to form a toner image; and a transfer unit that transfers the toner image onto a surface of a recording medium.

* * * * *